US006779475B1

(12) United States Patent
Crane et al.

(10) Patent No.: US 6,779,475 B1
(45) Date of Patent: Aug. 24, 2004

(54) LAUNCH AND RECOVERY SYSTEM FOR UNMANNED UNDERWATER VEHICLES

(75) Inventors: Jan W. Crane, Panama City, FL (US); Helmut Portmann, Panama City Beach, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/663,058

(22) Filed: Sep. 15, 2003

(51) Int. Cl.[7] ..... B63B 35/44
(52) U.S. Cl. ..... 114/258; 114/259
(58) Field of Search ..... 114/258–260, 368, 114/369, 370, 371, 372

(56) References Cited

U.S. PATENT DOCUMENTS 3,934,530 A * 1/1976 Kossa et al. ..... 114/260
5,253,605 A * 10/1993 Collins ..... 114/259
5,378,851 A * 1/1995 Brooke et al. ..... 114/259

* cited by examiner

*Primary Examiner*—Ed Swinehart
(74) *Attorney, Agent, or Firm*—James T. Shepherd; Donald G. Peck

(57) ABSTRACT

A launch and recovery system for unmanned underwater vehicles (UUV) includes a watercraft with a stern endwall movable between a vertical position and a ramp position that is angled downward toward the water surface. A storage platform mounted on the watercraft and terminating at the stern endwall defines a storage area for UUVs. An arm is pivotally mounted to the watercraft at a position forward of the storage platform. The arm has an outboard end that can be extended to positions aft of the watercraft and on either side thereof. The arm is also retractable such that its outboard end is positionable over the storage platform. A capture mechanism is mounted to the outboard end of the arm and is used to capture a UUV that maneuvers thereto in the water. A homing mechanism is coupled to the arm and is used to transmit a homing signal through the water for use by the UUV in maneuvering towards the capture mechanism.

24 Claims, 3 Drawing Sheets

LAUNCH AND RECOVERY SYSTEM FOR UNMANNED UNDERWATER VEHICLES

ORIGIN OF THE INVENTION

The invention described herein was made in the performance of official duties by employees of the Department of the Navy and may be manufactured, used, licensed by or for the Government for any governmental purpose without payment of any royalties thereon.

FIELD OF THE INVENTION

The invention relates generally to launch and recovery systems used at sea, and more particularly to a system mounted onboard a vessel that can launch and recover one or more unmanned underwater vehicles (UUVs).

BACKGROUND OF THE INVENTION

Small unmanned systems such as unmanned undersea vehicles (UUVs) are generally considered to be vehicles not more than 12 feet in length. However, even these small vehicles can weigh up to several thousand pounds. Current launch and recovery techniques for these smaller unmanned systems from large surface ships are manually intensive. The ship usually must slow for significant periods of time to allow the UUVs to be launched or recovered. Alternatively, the UUVs may have to be loaded into Rigid Hull Inflatable Boats (RHIBs) or other auxiliary boats that are manned and launched from the large mother ship. Onboard the auxiliary boat or RHIB, personnel must physically lift the UUVs overboard into the water. Depending on sea state and/or the hostile nature of the deploying environment, launch and recovery from RHIBs or other auxiliary boats places personnel in harms way and can significantly impact large ship positioning and operations.

SUMMARY OF THE INVENTION

Accordingly, it is an object of the present invention to provide a system that can be used to launch and recover UUVs from the surface of the water.

Another object of the present invention to provide a system that can be remotely or autonomously controlled to launch and recover UUVs from the surface of the water.

Other objects and advantages of the present invention will become more obvious hereinafter in the specification and drawings.

In accordance with the present invention, a launch and recovery system for unmanned underwater vehicles (UUV) includes a watercraft capable of navigating on a water surface. The watercraft has a stern endwall movable between a first position and a second position. In the first position, the stern endwall is substantially vertical. In the second position, the stern endwall is angled downward and away from the watercraft to define a ramp that extends toward the water surface. A storage platform mounted on the watercraft defines a storage area for at least one UUV. The storage platform has a forward end and an aft end with the aft end terminating at the stern endwall. An arm is pivotally mounted to the watercraft at a position forward of the storage platform. The arm has an outboard end that can be extended to positions aft of the watercraft and on either side thereof based on a pivot position of the arm. The arm is retractable such that its outboard end is positionable over the storage platform. A capture mechanism is mounted to the outboard end of the arm and is used to capture a UUV that maneuvers thereto in the water. A homing mechanism is coupled to the arm and is used to transmit a homing signal through the water for use by the UUV in maneuvering towards the capture mechanism.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
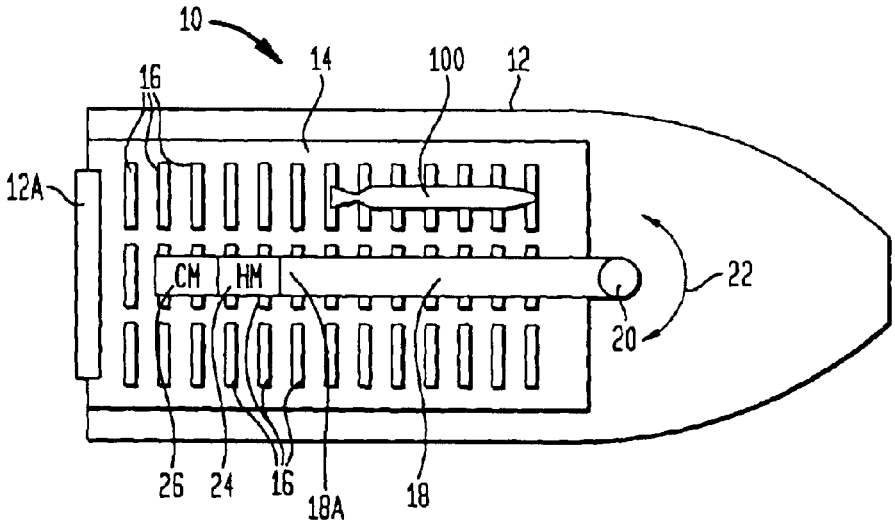
FIG. 1 is a top plan view of a launch and recovery system for unmanned underwater vehicles (UUVs) in accordance with an embodiment of the present invention.

Referring now to the drawings, and more particularly to FIG. 1, one embodiment of a launch and recovery system in accordance with the present invention is shown and is referenced generally by numeral 10. System 10 is capable of launching and recovering one or more unmanned underwater vehicles (UUVs) from the surface of a body of water. To more clearly illustrate system 10, only one such UUV 100 is shown stored onboard system 10.

Launch and recovery system 10 is based onboard a watercraft 12 which can be manned or unmanned, but must be capable of navigation on the water's surface. Such navigation can be manually-controlled onboard watercraft 12, autonomously controlled by systems onboard watercraft 12, or remotely-controlled by personnel/systems located remotely with respect to watercraft 12. Each of these navigation scenarios is well known in the art and will not be described further herein. Accordingly, it is to be understood that the choice of navigation scenario used to control the maneuvering of watercraft 12 is not a limitation of the present invention.

Figure 2:
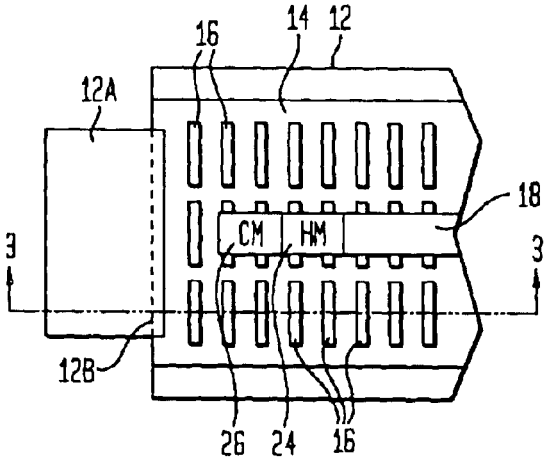
FIG. 2 is a top plan view of the stern end of the launch and recovery system configured for the launching or recovery of UUVs.
Figure 3:
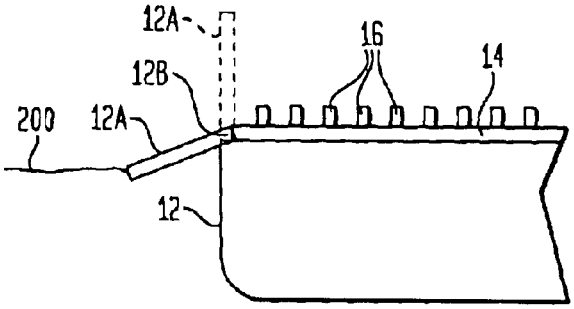
FIG. 3 is a side view of the stern end taken along line 3—3 of FIG. 2.

Referring additionally to FIGS. 2 and 3, watercraft 12 includes a movable side or wall 12A at the stern thereof. Stern wall 12A is movable between an upright or vertical position (illustrated in FIG. 1 and in phantom in FIG. 3) and an angled or ramp position (illustrated in FIGS. 2 and 3). The upright or vertical position of stern wall 12A is used when watercraft 12 is traveling to or from launch and recovery venues whereas the angled or ramp position is used when UUVs 100 are being launched into the water 200 or recovered therefrom. Typically, stern wall 12A is pivotally mounted to watercraft 12 at a horizontal pivot axis 12B that substantially coincides with bottom of stern wall 12A.

Mounted on watercraft 12 is a storage platform 14 defined by a bed of individual supports 16 on which UUVs 100 rest. The number, size and orientation of supports 16 depend on the type used as would be well understood by one of ordinary skill in the art. Regardless of the type used, supports 16 define the points of contact with UUVs 100. Support platform 14 terminates at approximately the bottom of stern wall 12A, e.g., at approximately horizontal pivot axis 12B. For reasons that will be explained further below, supports 16 also facilitate movement of UUVs 100 thereon during both the launch and recovery thereof.

A boom or arm 18 is mounted to watercraft 12 at a position forward of storage platform 14. More specifically, arm 18 is pivotally mounted to watercraft 12 at a point 20 such that arm 18 can pivot about point 20 in either direction as indicate by two-headed arrow 22. In addition to being able to pivot about point 20, arm 18 should be able to (i) extend in length so that the outboard end 18A of arm 18 can be positioned in the water on either side of watercraft 12 and aft of watercraft 12, and (ii) retract in length so that outboard end 18A can be positioned over storage platform 14. Accordingly, arm 18 is typically a telescopic arm that can be extended and retracted.

Coupled to outboard end 18A of arm 18 are a homing mechanism ("HM" in the figures) 24 and a capture mechanism ("CM" in the figures) 26. During a recovery operation, arm 18 is extended and positioned so that homing mechanism 24 and capture mechanism 26 are in the water. Homing mechanism 24 produces a guidance or homing signal that can be transmitted through the water for use by the UUV in maneuvering towards capture mechanism 26 during a recovery operation. Homing mechanism 24 can be an acoustic-based system that generates an acoustic signal or can be an optical-based system that generates an optical signal. One such optical-based homing system is disclosed in a U.S. patent application Ser. No. 10/609,902.

Figure 4:
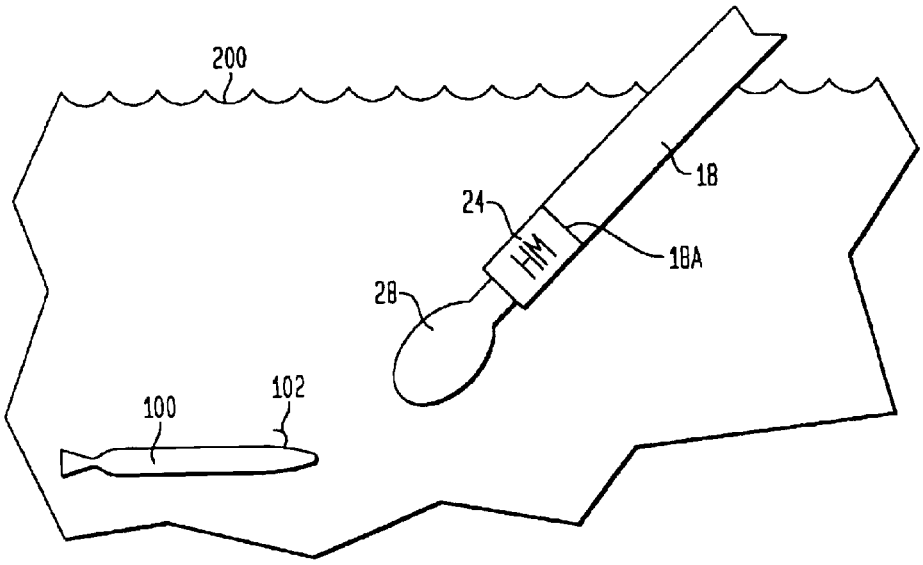
FIG. 4 is an isolated view of the outboard end of the launch and recovery system's retractable arm outfitted with (i) a homing device for guiding a UUV thereto and (ii) a capture loop that cooperates with a nose-mounted hook on a UUV that has maneuvered thereto.

Capture mechanism 26 serves as the means to collect or recover a UUV that has completed its underwater mission. As shown in FIG. 4, realization of capture mechanism 26 can be achieved simply with a loop 28 (e.g., a wire loop, cable loop, etc.) that will cooperate with a hook 102 mounted on a UUV 100 that has maneuvered thereto in water 200. A loop-based capture mechanism has the advantage of being simple, lightweight and inexpensive. However, the present invention is not so limited. Other prior art systems that can be used for capture mechanism 26 include recovery "baskets" or "cones" that have automatic latch mechanisms included therein for positively engaging a UUV that has entered same.

Figure 5:
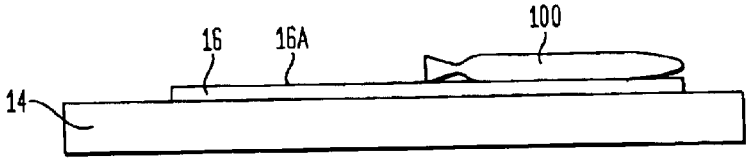
FIG. 5 is an isolated side view of one embodiment of the launch and recovery system's UUV storage platform that utilizes low-friction slides for UUV support.
Figure 6:
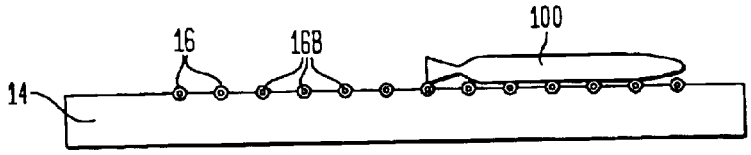
FIG. 6 is an isolated side view of another embodiment of the launch and recovery system's UUV storage platform that utilizes freely-rotating rollers for UUV support.

As mentioned above, support platform 14 is defined by a number of individual supports 16 that both support and facilitate movement of UUVs 100 thereon. Supports 16 can be passive or active in terms of facilitating movement of UUVs 100 thereon. For example, two types of passive supports are illustrated in FIGS. 5 and 6. Specifically, FIG. 5 illustrates supports 16 that are fixed-position, low-friction slides that can be realized using long lengths of material having a low-friction support surface 16A with which UUVs 100 come in contact. Suitable materials for such low-friction supports include silicone, silicone coated or impregnated plastics, plastics coated or impregnated with low-friction materials such as any commercially-available low friction material (e.g., TEFLON). Another type of passive support is illustrated in FIG. 6 where each of supports 16 is a freely-rotating wheel that is rotationally mounted to support platform 14 at an axis of rotation 16B such that a portion of each support (wheel) 16 resides above support platform 14.

Figure 7:
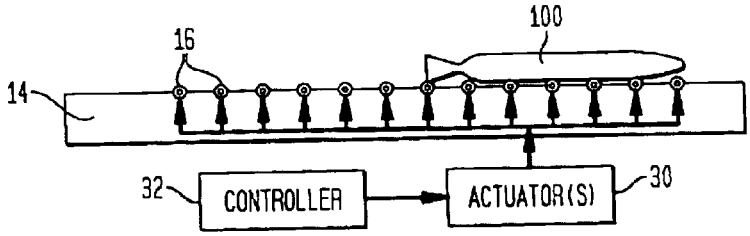
FIG. 7 is an isolated side view of another embodiment of the launch and recovery system's UUV storage platform that utilizes controllable motorized rollers for UUV support.

Referring now to FIG. 7, each of supports 16 can also be an individually-controllable support whereby a plurality of such supports can be moved to define a path of movement used to manipulate a UUV. For example, support platform 14/supports 16 can be configured as a "smart" floor system such as that disclosed in U.S. patent application Ser. No. 10/263,290, filed Sep. 30, 2002, the contents of which are hereby incorporated by reference. Briefly, each of supports 16 in FIG. 7 could be an omni-directional roller-wheel such as that disclosed in U.S. Pat. Nos. 3,876,255 and 6,340,065, the contents of which are hereby incorporated by reference.

Rotation of support (wheels) 16 is controlled such that a path and direction of movement is defined over support platform 14. The path could be straight or shaped (e.g., zig-zag, curved, etc.). The path and its direction of movement can be controlled to manipulate a UUV over support platform 14. Supports (wheels) 16 are controlled individually or in groups thereof by means of actuator(s) 30 coupled thereto. Actuator(s) 30 are controlled by a controller 32 that can receive its instructions from any viable source, the choice of which is not a limitation of the present invention. One system for controlling groups of supports (wheels) 16 to produce two-dimensional movement in any direction on support platform 14 is disclosed in U.S. Pat. No. 4,981,209, the contents of which are hereby incorporated by reference.

Figure 8:
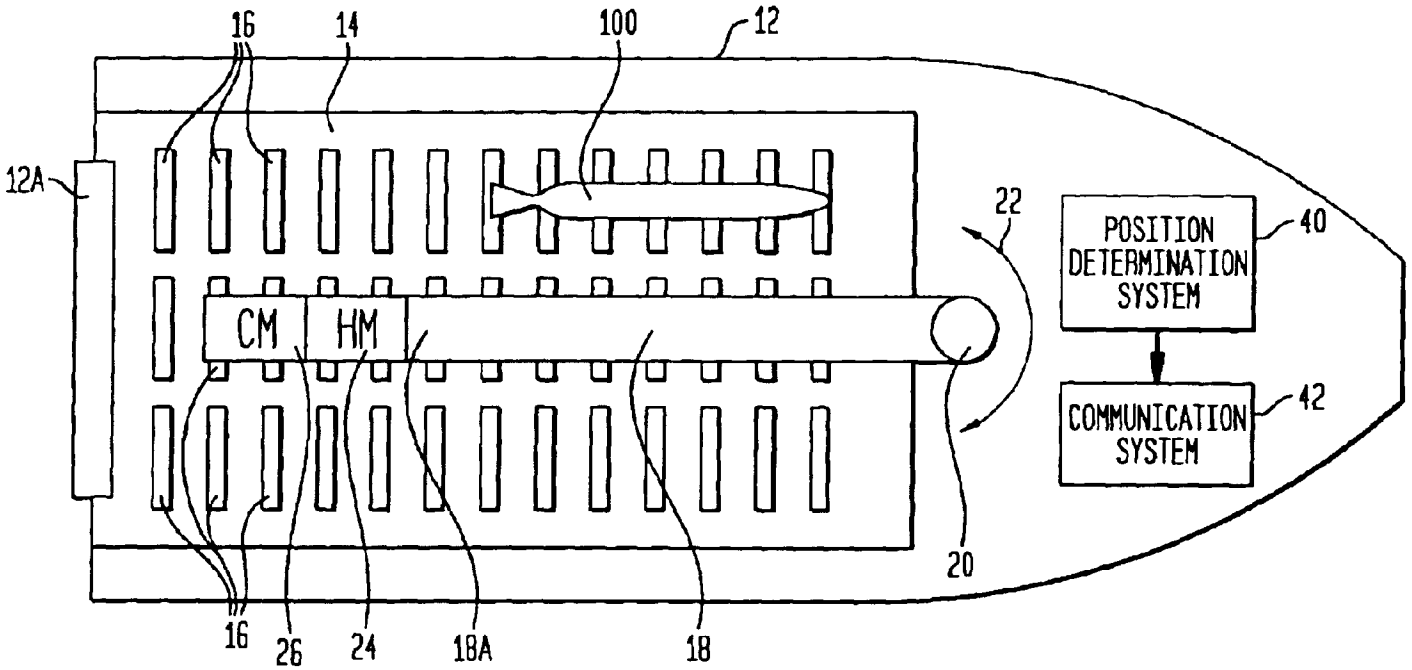
FIG. 8 is a top plan view of another embodiment of the launch and recovery system that is equipped to determine its own global position and then communicate such global position information through the water.

As noted above, watercraft 12 can be manned or unmanned. If manned, navigation can be completely manual or can be aided or enhanced by a variety of well known navigation aids utilizing, for example, inertial navigation systems, the Global Positioning System (GPS), etc. If watercraft 12 is unmanned thereby requiring autonomous or remote controlled navigation, GPS navigation aids would typically be utilized. Accordingly, FIG. 8 depicts an alternative embodiment of the present invention in which watercraft 12 has a position determination system 40 included onboard. The global position determined by system 40 can be used by the navigation system (not shown) utilized by watercraft 12. In addition, the global position of watercraft 12 could be provided to UUVs 100 deployed in the water so that each deployed UUV would always know where its "mother" ship was located. In this way, homing mechanism 24 need only provide "close in" guidance for a UUV 100 that is to be recovered. This will minimize the power requirements of homing mechanism 24.

Communication of the global position of watercraft 12 through the water can be achieved using a communication system 42 (e.g., an acoustic transmitter) coupled to position determination system 40. Such underwater communication would be understood by one of ordinary skill in the art and will, therefore, not be described further herein. Furthermore, communication system 42 could include "through-the-air" transmission/reception capability to upload/download information to/from a remote host. Still further, communication system 42 could include a direct data transfer interface (not shown) mounted at capture mechanism 26 so that a captured UUV could quickly download any gathered information which, in turn, could be relayed to a remote location by communication system 42.

Launch and recovery operations using the present invention will proceed as follows. In terms of a launch operation, once watercraft 12 has reached a desired geographic location on the water's surface, stern wall 12A is moved to the ramp position illustrated in FIG. 3. If supports 16 are passive (e.g., FIGS. 5 or 6 embodiments), watercraft 12 is then accelerated forward so that UUVs 100 on storage platform 14 move aft on supports 16 and are deployed into the water to begin their mission. To avoid collisions between deploying ones of UUVs 100, support platform 14 can incorporate movable stops or restraints (not shown) so that only one UUV 100 is free to move on supports 16 as watercraft 12 is accelerated forward. If supports 16 are active (e.g., FIG. 7 embodiment), watercraft 12 can remain stationary and a UUV 100 can be manipulated on supports 16 and propelled off support platform 14 and onto the ramp formed by stern wall 12A.

In terms of a recovery operation, watercraft 12 is again navigated to a recovery location on the water's surface. This location can be known in advance by a deployed UUV or can be transmitted thereto as described above with respect to the FIG. 8 embodiment. In either case, once a deployed UUV is close to watercraft 12, arm 18 is extended and deployed to either side of watercraft 12 with outboard end 18A being positioned in the water. Homing mechanism 24 transmits its guidance signal through the water. The approaching UUV utilizes the guidance signal to maneuver itself into a position whereby capture mechanism 26 can be coupled to the UUV. Once the UUV is coupled to capture mechanism 26, arm 18 is pivoted to a position that aligns outboard end 18A aft of stern wall 12A which is again lowered to the ramp position. Pivoting of arm 18 can be mechanized and/or aided by water flow past watercraft 12. When the captured UUV is aft of stern wall 12A, arm 18 is retracted and the captured UUV is pulled back onto support platform 14 and supports 16. If supports 16 are passive, arm 18 is used to manipulate the retrieved UUV on support platform 14. However, if supports 16 are actively-controlled, supports 16 can be used to manipulate the retrieved UUV on support platform 14 as described above.

The advantages of the present invention are numerous. UUVs can be launched and recovered without requiring personnel to physically handle/lift the UUVs. Further, the present invention lends itself to being a completely unmanned system thereby eliminating risk to any personnel during UUV launch and recovery operations.

Although the invention has been described relative to a specific embodiment thereof, there are numerous variations and the that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. A launch and recovery system for unmanned underwater vehicles (UUV), comprising:

a watercraft capable of navigating on a water surface, said watercraft having a stern endwall movable between a first position and a second position, said stern endwall being substantially vertical in said first position and being angled downward and away from said watercraft to define a ramp that extends toward the water surface in said second position;

a storage platform mounted on said watercraft for defining a storage area for at least one UUV, said storage platform having a forward end and an aft end wherein said aft end terminates at said stern endwall;

an arm pivotally mounted to said watercraft at a position forward of said storage platform, said arm having an outboard end that can be extended to positions aft of said watercraft and on either side thereof based on a pivot position of said arm, said arm being retractable such that said outboard end is positionable over said storage platform;

capture means, mounted to said outboard end of said arm, for capturing a UUV that maneuvers thereto; and homing means coupled to said arm for transmitting a homing signal through the water for use by the UUV in maneuvering to said capture means.

2. A launch and recovery system as in claim 1 wherein said storage platform comprises a bed of freely-rotating rollers that support each said UUV thereon.

3. A launch and recovery system as in claim 1 wherein said storage platform comprises a bed of low-friction slides that support each said UUV thereon.

4. A launch and recovery system as in claim 1 wherein said storage platform comprises a bed of motorized rollers that support each said UUV thereon.

5. A launch and recovery system as in claim 4 further comprising means coupled to said motorized rollers for selective operation thereof wherein each said UUV can be manipulated on said storage platform.

6. A launch and recovery system as in claim 1 wherein said capture means comprises a loop for cooperation with a hook mounted on each said UUV.

7. A launch and recovery system as in claim 1 wherein said homing means is an acoustic-based system that generates an acoustic signal as said homing signal.

8. A launch and recovery system as in claim 1 wherein said homing means is an optical-based system that generates an optical signal as said homing signal.

9. A launch and recovery system for unmanned underwater vehicles (UUV), comprising;

a watercraft capable of navigating on a water surface, said watercraft having a stern endwall pivotable about a horizontal axis thereof between a first position and a second position, said stern endwall being substantially vertical in said first position and being angled downward and away from said watercraft to define a ramp that extends toward the water surface in said second position;

a storage platform mounted on said watercraft for defining a storage area for at least one UUV, said storage platform having a forward end and an aft end wherein said aft end terminates at said horizontal axis;

a telescopic arm pivotally mounted to said watercraft at a position forward of said storage platform, said telescopic arm having an outboard end that can be extended to positions aft of said watercraft and on either side thereof based on a pivot position of said telescopic arm, said telescopic arm being retractable such that said outboard end is positionable over said storage platform from said positions aft of said watercraft;

capture means, mounted to said outboard end of said telescopic arm, for capturing a UUV that maneuvers thereto; and homing means coupled to said telescopic arm for transmitting a homing signal through the water for use by the UUV in maneuvering to said capture means.

10. A launch and recovery system as in claim 9 wherein said storage platform comprises a bed of freely-rotating rollers that support each said UUV thereon.

11. A launch and recovery system as in claim 9 wherein said storage platform comprises a bed of low-friction slides that support each said UUV thereon.

12. A launch and recovery system as in claim 9 wherein said storage platform comprises a bed of motorized rollers that support each said UUV thereon.

13. A launch and recovery system as in claim 12 further comprising means coupled to said motorized rollers for selective operation thereof wherein each said UUV can be manipulated on said storage platform.

14. A launch and recovery system as in claim 9 wherein said capture means comprises a loop for cooperation with a hook mounted on each said UUV.

15. A launch and recovery system as in claim 9 wherein said homing means is an acoustic-based system that generates an acoustic signal as said homing signal.

16. A launch and recovery system as in claim 9 wherein said homing means is an optical-based system that generates an optical signal as said homing signal.

17. A launch and recovery system for unmanned underwater vehicles (UUV), comprising:

a watercraft capable of navigating on a water surface, said watercraft having a stern endwall movable between a first position and a second position, said stern endwall being substantially vertical in said first position and being angled downward and away from said watercraft to define a ramp that extends toward the water surface in said second position;

position determination means mounted on said watercraft for determining a global position thereof on said water surface;

communication means mounted on said watercraft for transmitting a signal indicative of said global position through the water;

a storage platform mounted on said watercraft for defining a storage area for at least one UUV, said storage platform having a forward end and an aft end wherein said aft end terminates at said stern endwall;

an arm pivotally mounted to said watercraft at a position forward of said storage platform, said arm having an outboard end that can be extended to positions aft of said watercraft and on either side thereof based on a pivot position of said arm, said arm being retractable such that said outboard end is positionable over said storage platform;

capture means, mounted to said outboard end of said arm, for capturing a UUV that maneuvers thereto; and homing means coupled to said arm for transmitting a homing signal through the water for use by the UUV in maneuvering to said capture means.

18. A launch and recovery system as in claim 17 wherein said storage platform comprises a bed of freely-rotating rollers that support each said UUV thereon.

19. A launch and recovery system as in claim 17 wherein said storage platform comprises a bed of low-friction slides that support each said UUV thereon.

20. A launch and recovery system as in claim 17 wherein said storage platform comprises a bed of motorized rollers that support each said UUV thereon.

21. A launch and recovery system as in claim 20 further comprising means coupled to said motorized rollers for selective operation thereof wherein each said UUV can be manipulated on said storage platform.

22. A launch and recovery system as in claim 17 wherein said capture means comprises a loop for cooperation with a hook mounted on each said UUV.

23. A launch and recovery system as in claim 17 wherein said homing means is an acoustic-based system that generates an acoustic signal as said homing signal.

24. A launch and recovery system as in claim 17 wherein said homing means is an optical-based system that generates an optical signal as said homing signal.

* * * * *